US005963765A

United States Patent [19]

Hirata et al.

[11] Patent Number: 5,963,765

[45] Date of Patent: Oct. 5, 1999

[54] METHOD AND DEVICE FOR DEVELOPING AN ELECTROSTATIC LATENT IMAGE BASED ON TONER AMOUNT AND IMAGE FORMATION SYSTEM USING THE DEVELOPING DEVICE

[75] Inventors: Kei Hirata; Tomio Ohnuki; Ikutaroh Nagatsuka; Hiroo Soga, all of Ebina, Japan

[73] Assignee: Fuji Xerox Co., Ltd., Tokyo, Japan

[21] Appl. No.: 08/994,018

[22] Filed: Dec. 18, 1997

[30] Foreign Application Priority Data

Dec. 26, 1996 [JP] Japan ..... 8-357045

[51] Int. Cl.[6] ..... G03G 15/08

[52] U.S. Cl. ..... 399/252; 399/272

[58] Field of Search ..... 399/252, 267, 399/272

[56] References Cited

FOREIGN PATENT DOCUMENTS

A 62-284365 12/1987 Japan .
A 2-93671 4/1990 Japan .
A 2-242267 9/1990 Japan .
A 5-150550 6/1993 Japan .
A 8-194381 7/1996 Japan .
8-328634 12/1996 Japan .

*Primary Examiner*—Fred L. Braun
*Attorney, Agent, or Firm*—Oliff & Berridge, PLC

[57] ABSTRACT

A developing method for an image formation system includes the steps of supplying a toner and developing an electrostatic latent image formed on a latent image support of the image formation system with the toner for visualization. A toner amount of a solid area T(g/m$^2$) has a maximum toner amount per unit area on a recording medium and satisfies the following expression:

$$1 \leqq T/a \leqq 1.2$$

wherein $a=(4\pi/3)\cdot(dt/2)^3\cdot\rho t(\{(3)^{1/2}\cdot dt^2/2\}$ (g/m$^2$), where dt is a toner volume center diameter (m) and st is a toner density (g/m$^3$). A developing device for developing an electrostatic latent image includes toner amount regulation means for regulating a toner amount that satisfies the above expression.

10 Claims, 8 Drawing Sheets

FIG. 1(b)
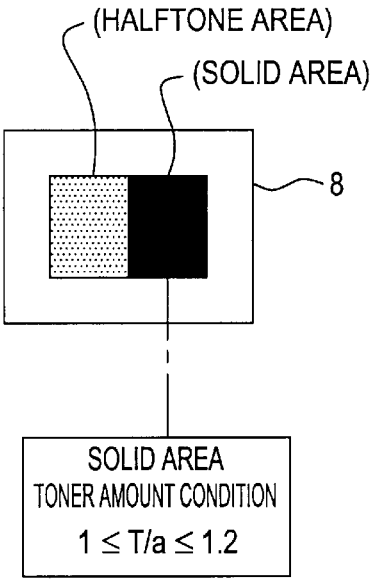
FIG. 1(a)
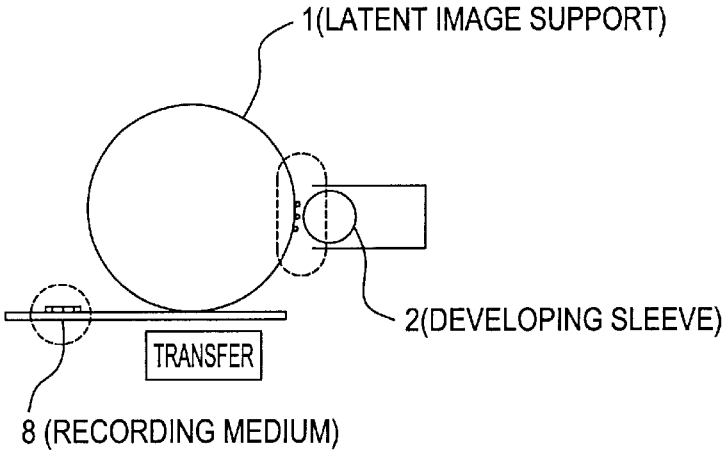
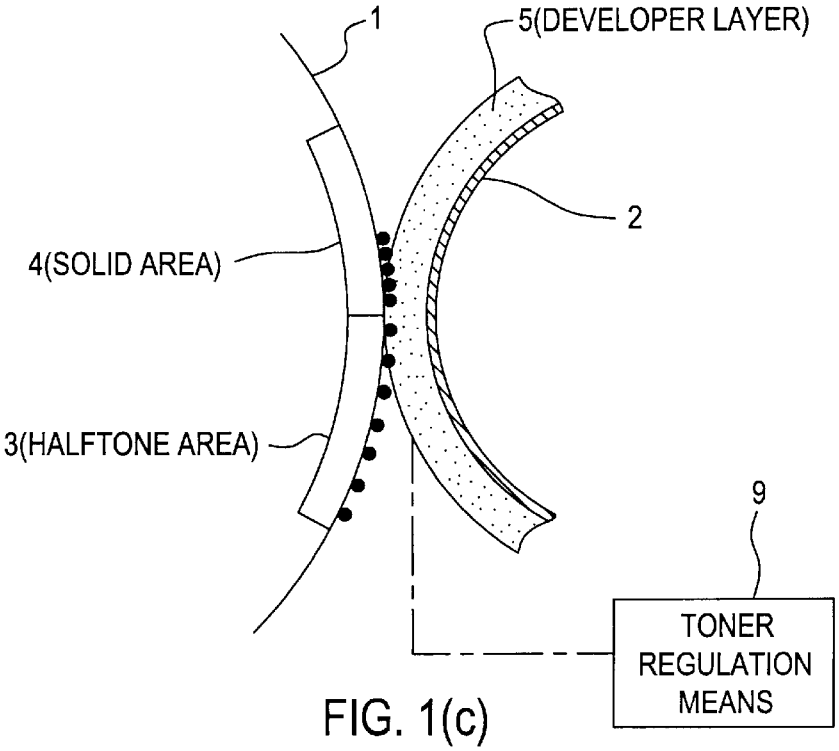
FIG. 1(c)

METHOD AND DEVICE FOR DEVELOPING AN ELECTROSTATIC LATENT IMAGE BASED ON TONER AMOUNT AND IMAGE FORMATION SYSTEM USING THE DEVELOPING DEVICE

BACKGROUND OF THE INVENTION

This invention relates to a developing method for visualizing an electrostatic latent image formed on a latent image support and in particular to a developing method and a developing device effective for forming an image requiring high image quality and an image formation system using the developing device.

In recent years, digital image output machines have increased remarkably with the widespread use of facsimiles and personal computers.

For example, demands for digital image output also grow for electrophotographic image formation systems and digitization with a digital-compatible exposure device installed in a conventional analog system moves.

In such an environment, the user who prepares documents becomes more flexible in planning to make his or her intention known to readers impressively documents with various fonts, hollow characters, shaded areas, halftone crosshatched background, etc., are zooming.

Although the conventional electrophotographic image formation systems have met user's demands centering on line drawings mainly composed of simple characters, some electrophotographic image formation systems unfortunately produce image defects on some of image patterns as in the example described above.

The image defects on which the inventor et al. focus attention are those occurring when backgrounds are halftone crosshatched. More particularly, when the background of a plane image having the maximum toner amount per unit area, such as a heavy line image or a solid plane image, which will be hereinafter referred to as "solid image," is crosshatched uniformly, a crosshatch skip (a skip in the halftone area adjoining the solid area) occurs on the boundary between the solid image and the background.

According to the study of the inventor et al., the skip in the halftone area adjoining the solid area is a technical problem that can occur regardless of which of dual and mono component developing systems is used as a developing device of an electrophotographic image formation system.

SUMMARY OF THE INVENTION

It is therefore an object of the invention to provide a developing method and a developing device for always providing good image quality with no skip in a halftone area adjoining a solid area and an image formation system using the developing device.

The inventor et al. tried solving the problem in the dual component developing system advantageous particularly to speeding up and coloring The occurrence principle of "skip in a halftone area adjoining a solid area" in the dual component developing system considered by the inventor et al. will be discussed with reference to FIG. 2.

FIG. 2 assumes a general developing system wherein a developing sleeve 2 and a latent image support 1 rotate in the same direction and the former rotates at higher surface-speed than the latter, and shows how the boundary between a halftone area 3 and a solid area 4 on the latent image support 1 rushes into a developing layer 5.

At this time, when the solid area 4 is developed with the developer, toner 6 on the top layer (surface layer) of the developer layer 5 is consumed and countercharge 7 occurs in the developer layer 5. It is thought that when the countercharge 7 approaches the halftone area 3 it disturbs a move of the toner 6 from the bottom layer of the developer layer 5, causing a skip in the halftone area 3 adjoining the solid area 4. Particularly, if the developing sleeve 4 rotates at higher surface speed than the latent image support 1, the developer layer 5 moves getting ahead of the latent image support 1 thus the countercharge 7 occurring as the toner is consumed for developing the solid area 4 wider blocks the halftone area 3 adjoining the solid area 4 and the skip in the halftone area 3 adjoining the solid area 4 more remarkably appears accordingly.

The edge effect of an electric field exists between the solid area 4 and the halftone area 3 and also weakens the developing electric field on the end margin of the halftone area 3 (electric field toward the toner developing direction)

In view of the occurrence principles the inventor et al. invent the following:

The developing method according to the invention is characterized by the fact that the following conditional expression (1) is satisfied when the toner amount of the solid area having the maximum toner amount per unit area on a recording medium 8 is T ($g/m^2$) when an electrostatic latent image formed on the latent image support 1 is developed with toner for visualization as shown in FIG. 1:

Conditional expression (1) $1 \leqq T/a \leqq 1.2$ wherein $a=(4\pi/3)\cdot(dt/2)^3\cdot\rho t/\{(3)^{1/2}\cdot dt^2/2\}$ ($g/m^2$) where dt is a toner volume center diameter (m) and ρt is a toner density ($g/m^3$).

Since a denotes the weight per unit area when the densest toner layer is applied (weight per toner particle $[(4\pi/3)\cdot(dt/2)^3\cdot\rho t]$/occupation area per toner particle $[(3)^{1/2}\cdot dt^2/2]$), the conditional expression (1) means that the number of toner layers of the solid area is about 1–1.2.

Such a developing method is effective particularly for the dual component developing system (a system using a dual component developer consisting of toner and carriers) advantageous to speeding up and coloring. It is also applicable to the mono component developing system, of courses because the toner amount required for image formation is reduced to the necessary minimum of 1–1.2 layers, whereby image formation with a small potential contrast is enabled and the edge effect weakens accordingly, so that the developing method also acts effectively on the mono component developing system.

A developing device using the developing method for embodying the invention for developing an electrostatic latent image formed on the latent image support 1 with toner for visualization may comprise toner amount regulation means for regulating the toner amount so as to satisfy the conditional expression (1) described above when the toner amount of a solid area having the maximum toner amount per unit area on the recording medium 8 is T ($g/m^2$).

The invention is also applied to an image formation system using the developing device according to the invention as a developing device for visualizing an electrostatic latent image on the latent image support 1.

The developing method according to the invention in the dual component developing system was furthermore pursued.

First, if the toner concentration is too lowered, a sweep pattern and gradation reproduction crush (a phenomenon of insufficient toner supply to a high-potential contrast portion of a latent image) appears, thus it is necessary to satisfy the minimum necessary toner supply amount.

The minimum necessary toner supply amount is determined in correlation with the toner diameter.

That is, the following conditional expression (2) needs to be satisfied:

$$\text{Conditional expression (2): } M \cdot Rt \cdot v \geqq a/(k \cdot s \times 10^{-6})$$

wherein M ($g/m^2$) is the developer deposition amount per unit area on the developing sleeve 2, Rt (wt %) is the toner concentration in the developers v is the surface speed ratio of the developing sleeve 2 to the latent image support 1, s (wt %) is the toner transfer rate from the developing sleeve 2 to the latent image support 1, and k (wt %) is the transfer rate in a transfer process, as shown in FIG. 1.

The conditional expression (2) is based on the fact that T (toner amount of a solid area having the maximum toner amount per unit area on the recording medium 8) is equal to or greater than a (weight per unit area when the densest toner layer is applied) and satisfies the relational expression $T/(k \cdot s)=M \cdot Rt \cdot v \times 10^{-6}$.

Here, additional information is provided on $T/(k \cdot s)=M \cdot Rt \cdot v \times 10^{-6}$.

Now, assuming that the speed of the developing sleeve 2 is Vs (m/sec) and that the speed of the latent image support 1 is Vk (m/sec), the developer transport amount per unit time on the developing sleeve 2 is M×Vs and therefore the toner transport amount per unit time on the developing sleeve 2 is $M \times Vs \times (Rt \times 10^{-2})$ Thus, the toner developing amount to the latent image support 1 per unit time is $M \times (Vs/Vk) \times (Rt \times 10^{-2}) \times (s \times 10^{-2})=M \cdot v \cdot (Rt \times 10^{-2}) \times (s \times 10^{-2})$ if the latent image support 1 speed Vk is considered; the toner amount per unit time transferred to the recording medium 8 is $M \times v \times (Rt \times 10^{-2}) \times (s \times 10^{-2}) \times (k \times 10^{-2})$ if the transfer rate k in the transfer process is considered. The value becomes equal to T at the maximum.

The toner transfer rate s normally is 35% or less; it is high under a high-humidity condition and low under a low-humidity condition.

It is preferred to use carriers having practical resistivity defined by the following measurement method ranging from $10^6$ (Ω) to $10^{10}$ (Ω) for the resistance characteristic of the carriers:

the measurement method comprising the steps of depositing carriers of 500±25 ($g/m^2$) on the developing sleeve for forming heads, opposing the developing sleeve to a conductive pipe having the same diameter as the latent image support, holding the gap between the developing sleeve and the conductive pipe to t (cm), applying a direct current of 1,000 (V) between the developing sleeve and the conductive pipe, finding resistance R (Ω), and defining ρ/L (Ω units) found from $R=\{t/(b \cdot L)\} \cdot \rho$ when t=0.05 cm as the practical resistivity where b (cm) is the length in the length direction of the developing sleeve for the heads to come in contact with the conductive pipe, L (cm) is the effective contact width in the circumferential direction of the developing sleeve, and ρ (Ω·cm) is volume resistivity of a carrier layer.

The upper limit value of the carrier resistance, $10^{10}$ (Ω), indicates the limit on promoting a move of countercharge in the developer layer (see FIG. 2) and the lower limit value $10^6$ (Ω) indicates the limit for avoiding occurrence of latent image leak.

From the viewpoint of easily setting the practical resistivity in the desirable ranges carriers each having a volume center diameter less than $50 \times 10^{-6}$ m and equal to or greater than $30 \times 10^{-6}$, preferably equal to or less than $40 \times 10^{-6}$ m and equal to or greater than $30 \times 10^{-6}$ are used.

Further, from the viewpoint of promoting a move of countercharge in the developer layer, preferably the gap between the latent image support 1 and the developing sleeve 2 is 0.2 to $0.4 \times 10^{-3}$, an AC component is overlapped on the developing bias, and the toner coverage on the carrier surface is 55% or less in the following toner coverage calculation method:

$$\text{Toner coverage}=(Rt/4) \cdot (dc/dt) \cdot (\rho c/\rho t)$$

wherein dt (m) is the toner volume center diameters ρt ($g/m^3$) is the toner density, dc (m) is the carrier volume center diameters ρc ($g/m^3$) is the carrier density, and Rt (wt %) is the toner concentration in the developer.

Here, additional information is provided on the toner coverage. When n toner particles surround one carrier, $$Rt=n \times (4/3)\pi \times (dt/2)^3 \times \rho t/\{(4/3)\pi \times (dc/2)^3 \times \rho c\}=n \times (dt/dc)^3 \times (\rho t/\rho c).$$

Therefore, $$Rt \times (dc/dt) \times (\rho c/\rho t)=n \times (dt/dc)^2.$$

On the other hand, toner coverage=$n \times \pi \times (dt/2)^2/\{4\pi \times (dc/2)^2\}$. When this expression is assigned the preceding expression, $$\begin{aligned}\text{toner coverage} &= (1/4) \times \pi \times (dt/dc)^2 \\ &= (1/4) \times Rt \times (dt/dt) \times (\rho c/\rho t).\end{aligned}$$

Next, the function of the above-described technical means will be discussed.

First, the toner amount is set so that the toner amount of the solid area having the maximum toner amount per unit area on the recording medium 8, T ($g/m^2$), satisfies conditional expression (1), whereby an image is formed at the toner concentration Rt lower than the conventional concentration and the countercharge disturbing a move of toner in the developer 5 decreases, moderating a skip in the halftone area 3 adjoining the solid area 4.

When toner is transported to the developing area so as to satisfy the relation of conditional expression (2), if the toner concentration Rt lowers, the toner amount required for image formation is provided and an image defect such as a sweep pattern occurring when the toner concentration overlowers is prevented.

If the practical resistivity defined by the above-described measurement method ranges from $10^6$ (Ω) to $10^{10}$ (Ω) for the resistance characteristic of the carriers, a move of the countercharge is promoted the skip is prevented and the image formation system can be operated in the area in which a sweep pattern can be prevented.

Small-diameter carriers typified by carriers each having a volume center diameter less than $50 \times 10^{-6}$ m and equal to or greater than $30 \times 10^{-6}$ are used, whereby while the necessary coat thickness that must be provided for carrier charge maintainability is maintained the resistivity of the heads of the carriers formerly hard to lower can be lowered and the practical resistivity is easily set in a desirable range accordingly.

A move of the countercharge is promoted and the skip is easily prevented by setting the gap between the latent image support and the developing sleeve to 0.2 to $0.4 \times 10^{-3}$ (m) overlapping an AC component onto a developing bias, and setting the toner coverage on the carrier surface to 55% or less in the above-described toner coverage calculation method.

BRIEF DESCRIPTION OF THE DRAWINGS

In the accompanying drawings:

FIG. 1 is a schematic illustration to show a developing method and a developing device according to the invention;

DETAILED DESCRIPTION OF THE PREFERRED EMBODIMENTS

Referring now to the accompanying drawings, there is shown a preferred embodiment of the invention.

Figure 2:
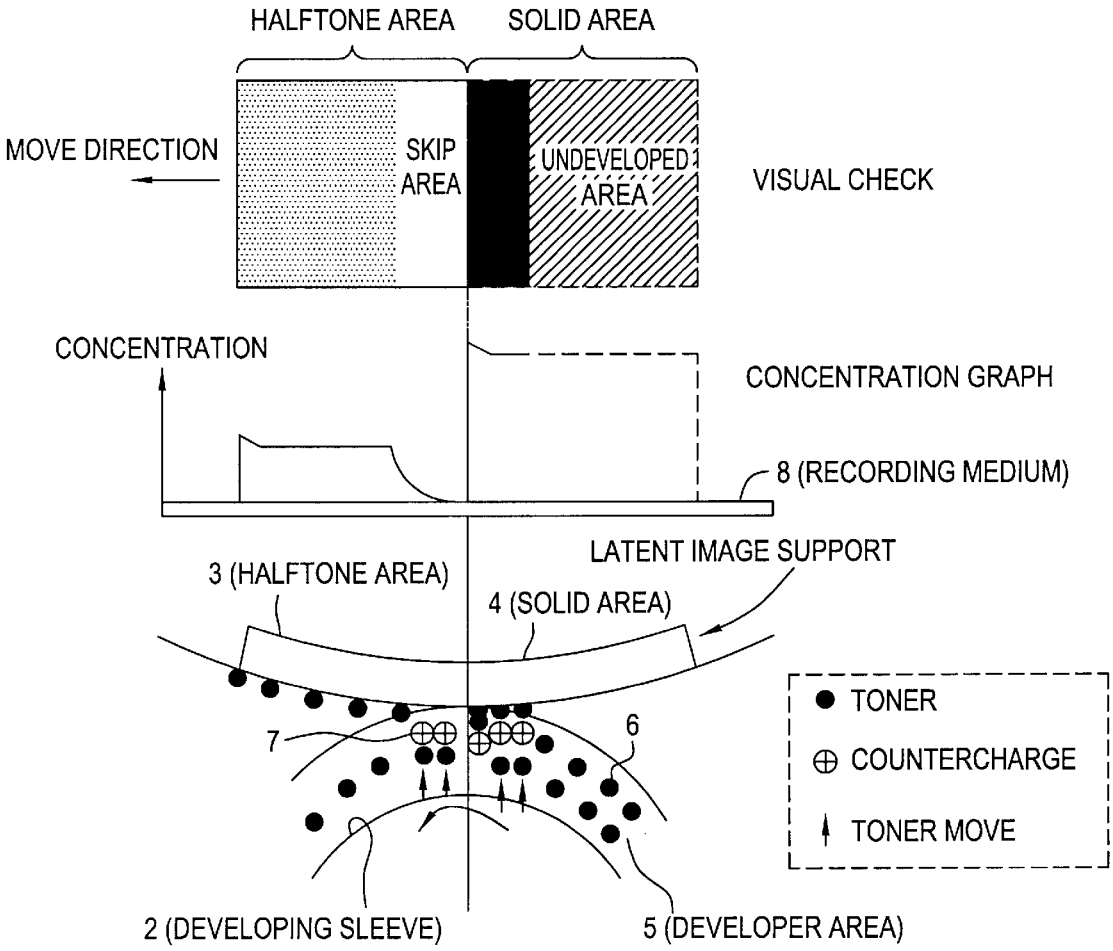
FIG. 2 is an illustration to show the occurrence principle of a skip in a halftone area adjoining a solid area.
Figure 3:
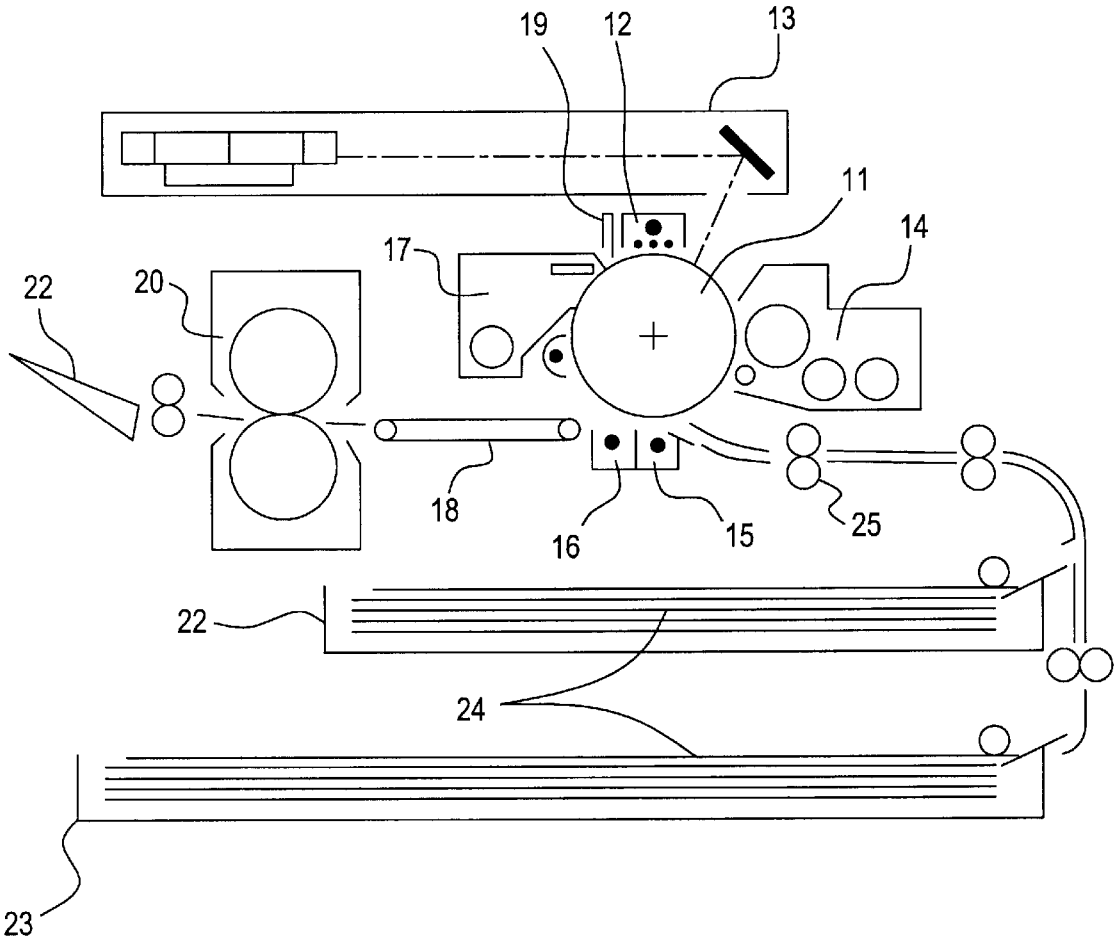
FIG. 3 is a schematic diagram to show the configuration of one embodiment of an image formation system to which the invention is applied.

FIG. 3 shows one embodiment of a digital-compatible electrophotographic image formation system to which the invention is applied.

In the figure, first a latent image support 11 is made of a negative-polarity photosensitive drum, for example, and is charged on the surface uniformly to the negative polarity by a uniform charger 12, such as a scotron. Next, an image compatible with a digital image is exposed by a laser exposure device 13 and an electrostatic latent image is formed on the surface of the latent image support 11.

A developing device 14 adopts a dual component developing system; when the tip of the electrostatic latent image corresponding to the image arrives at the developing position, a magnetic brush slides and rubs the electrostatic latent image for forming a toner image on the latent image support 11.

On the other hand, a recording medium 24 such as paper or a transparent sheet is transported from a tray 22 or 23 and is once blocked at the tip by a registration roll 25, then is sent out to a transfer section at a predetermined timing. The sent-out recording medium 24 comes in intimate contact with the toner image on the latent image support 11 and the toner image is transferred onto the recording medium 24 by the action of a transfer device 15 such as a corotron.

By the way, the latent image support 11 completing the toner image transfer then is subjected to before-cleaning processing as required, then the toner remaining on the surface of the latent image support 11 is scraped away by a cleaner 17 and further the charges remaining on the surface are eliminated by a static eliminator 19.

On the other hand, the recording medium 24 onto which the toner image has been transferred is separated from the latent image support 11 by a peel static eliminator 16 such as a corotron and a peeling finger (not shown) at the tip of a transport guide member 18 and the toner image is fixed on the recording medium 24 by a fuser 20 then the recording medium 24 is discharged to a discharge tray 21 outside the image formation system.

Figure 4:
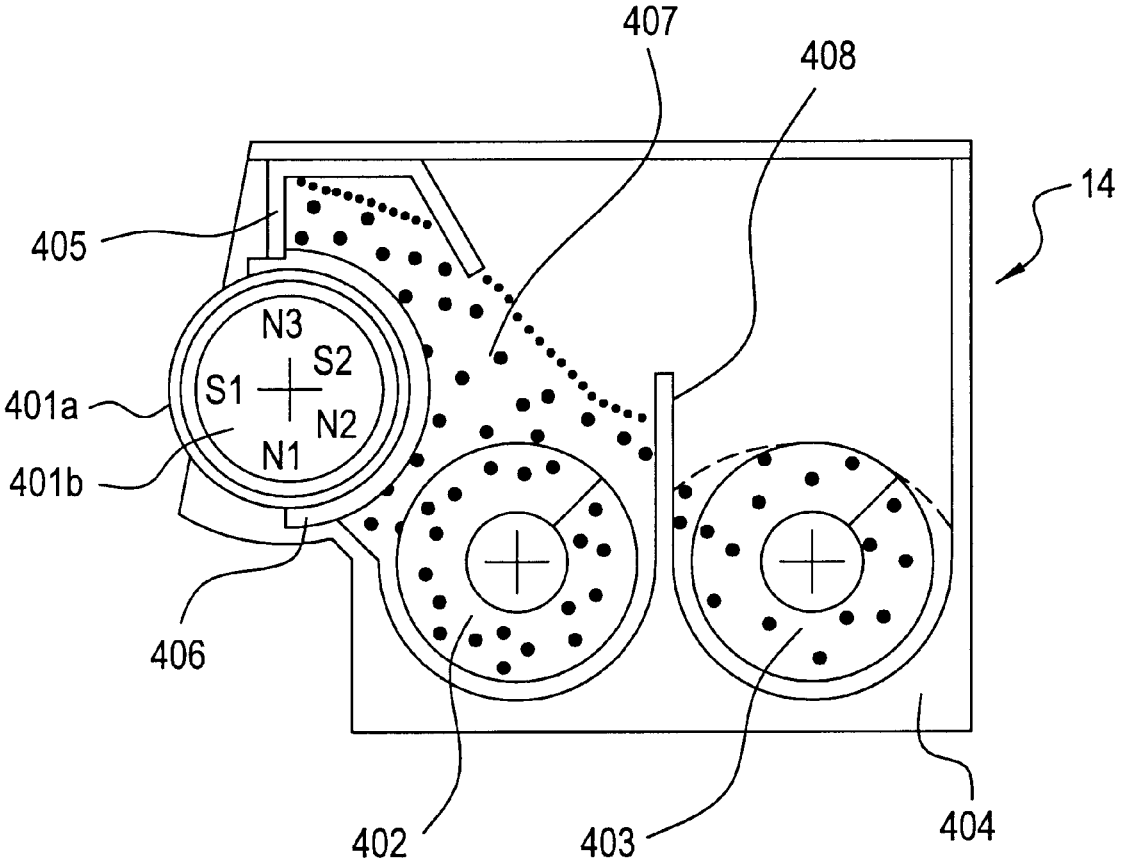
FIG. 4 is a schematic diagram of the configuration of a developing device used with the embodiment of the invention.

FIG. 4 is a schematic diagram of the configuration of the developing device 14 adopting the dual component developing system.

In the figure, the developing device 14 comprises a housing 404 opened facing the latent image support 11 and a developing roll 401 disposed fronting on the opening of the housing 404. For example, the developing roll 401 comprises a nonmagnetic developing sleeve 401*a* placed rotatably on the outside of a magnet roll 401*b* fixedly placed inside the developing roll 401. Developer agitation transport members 402 and 403 are disposed with a separation plate 408 between in the rear of the developing roll 401 for circulating a developer 407. Further, numeral 405 is a layer regulation member for regulating the layer of the developer transported onto the developing sleeve 401*a* and numeral 406 is a seal member for preventing the developer from leaking from the end of the developing sleeve 401*a*.

Particularly, in the embodiment, necessary and sufficient developer and developing conditions for solving the problem to be solved by the invention "skip in a halftone area adjoining a solid area" are set as follows:

First, for easy comparison with the embodiment, a conventional system example will be discussed.

A developer in a conventional developing device is prepared by mixing and agitating ferrite carriers, for example, each with a volume center diameter of $50\times10^{-6}$ (m) and a density of about $3.5\times10^{6}$ (g/m$^3$) and toner consisting essentially of styrene acrylic each particle with a volume center diameter of $9.5\times10^{-6}$ (m) and a density of about $1.1\times10^{6}$ (gm$^3$) so that the toner is to be used in the charge amount of about 20 ($\mu$C/g) in the image formation system.

The potential conditions required for image formation with the developer are set to −700 (V) as the uniform charge potential of latent image support 11, −200 (V) as the potential after the area in which the developing toner amount on the latent image support 11 reaches the maximum is exposed to lights and −550 (V) as the developing bias potential to suppress background fog. The developing conditions are set to $0.5\times10^{-3}$ (m) as the distance between developing sleeve and the latent image support, 500 (g/m$^2$) as the developer deposition amount on the developing sleeve 401*a*, and the circumferential speed of the developing sleeve 401*a* being 200 times that of the latent image support 11.

Here, the relationships among the developing toner weight required for image formation, the toner charge amount to provide the necessary developing amount, and the toner concentration in the developer to provide the necessary charge amount in the conventional developing system will be discussed using the lower part of FIG. 5.

In the potential and developing conditions, the developing toner weight in the solid area having the maximum developing toner amount on the latent image support 11 (−200 (V) area as the potential after exposure to light) is almost inversely proportional to the toner charge amount. The toner charge amount of the developer is almost inversely proportional to the toner concentration in the developer if the relative humidity in the atmosphere is constant. However, when the same toner concentration is applied, low charge results under high-humidity condition; high charge results under low-humidity condition. Therefore, the toner concentration range during the machine operation in the conventional system becomes the range indicated by the arrow in FIG. 5.

By the ways for the problem to be solved, the inventor et al. focused attention on developer layer resistivity from the image defect occurrence principle and used carriers prepared as a model to examine the relationship between the resistivity and main image defects including a skip in a halftone area adjoining a solid area. The result shown in the upper part of FIG. 5 was able to be obtained.

Figure 5:
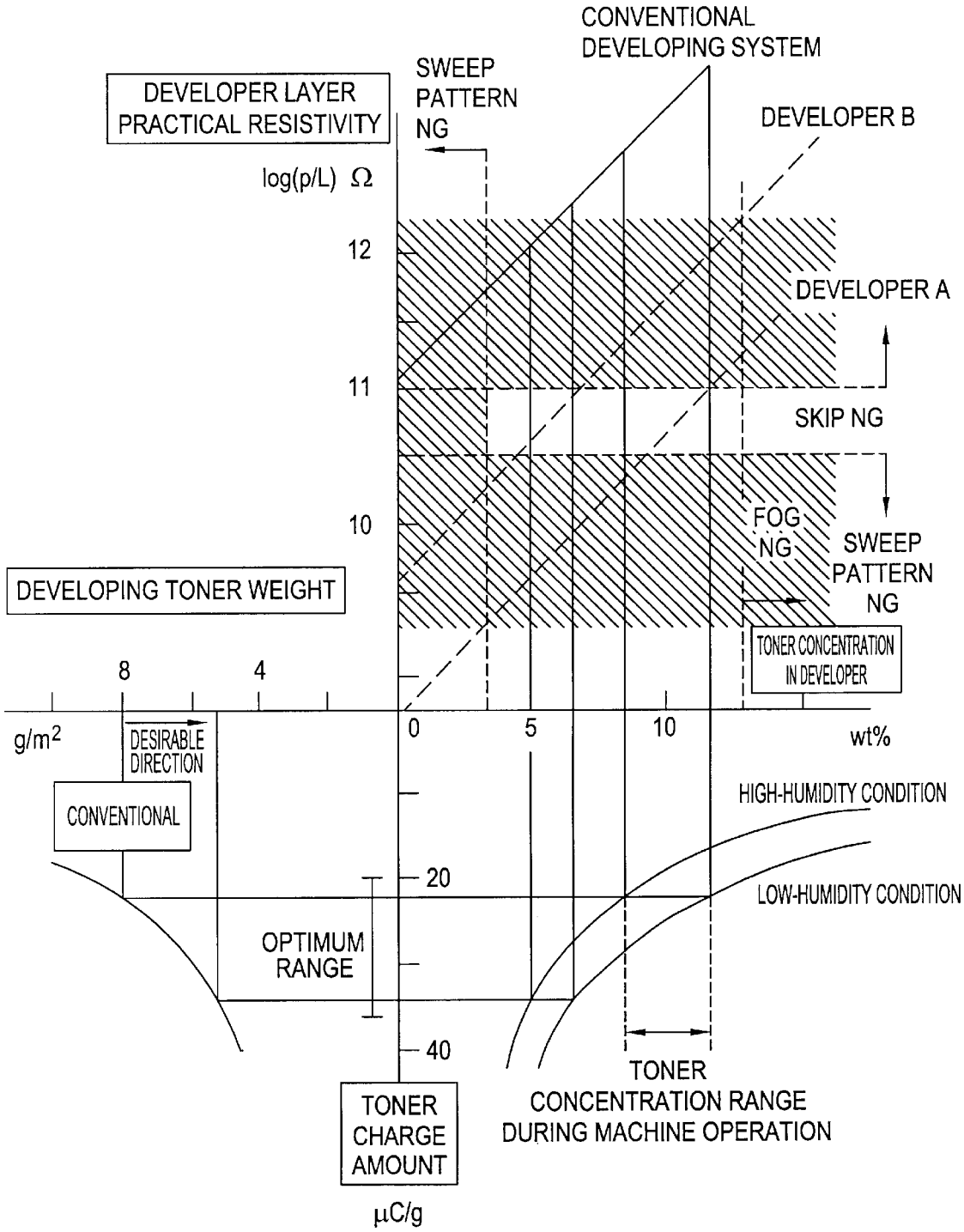
FIG. 5 is an illustration to show how to determine developer characteristics used in the embodiment of the invention.

However, the "practical resistivity of developer layer" in FIG. 5 is defined in the measurement method described in the above; in the embodiment, the resistivity is measured with the developer of the same volume as the volume of 500 ($g/m^2$) only with carriers deposited on the developing sleeve 401*a* at each level of the toner concentration in the developer.

As seen in FIG. 5, the problem of a skip in a halftone area adjoining a solid area cannot be solved throughout the toner concentration range during the machine operation in the conventional system.

For developer A, the carrier coat amount is decreased and the practical resistivity is lowered. Although the halftone area skip problem can be solved in the considerable area of the toner concentration range during the machine operation, the area where a sweep pattern occurs remains. If the toner concentration during the machine operation temporarily lowers when replenishment toner runs out, etc., the practical resistivity lowers, thus the risk of latent image leak is increased. Furthers if the carrier coat amount is overdecreased, the charge maintainability of the carriers cannot be provided; the developer A is not practical.

From the study, the problem of "a skip in a halftone area adjoining a solid area" can be replaced with (1) a problem of setting the developing toner weight to a low point to narrow the toner concentration range during the machine operations namely, to make the toner concentration range during the machine operation hard to change even if the atmosphere changes from high humidity to low humidity, which will be hereinafter referred to as replacement problem (1), and (2) a problem of realizing a developer having characteristics as developer B in FIG. 5 while providing the charge maintainability and efficient usage thereof, which will be hereinafter referred to as replacement problem (2).

For replacement problem (1), if the developing toner weight is lowered simply by lowering the toner concentration, etc., the ground of a recording medium shows even in the solid area having the maximum toner weight per unit area on the recording medium, remarkably impairing graininess. Thus, focusing attention on the phenomenon that smaller-particle-diameter toner can cover the recording medium 24 completely in a smaller amount, the toner amount T ($g/m^2$) of the solid area having the maximum toner weight per unit area on the recording medium 24 was lowered from 6.8 ($g/m^2$) with the diameter of $9.5\times10^{-6}$ (m) to 4.5 ($g/m^2$) with the diameter of $6.5\times10^{-6}$ (m) This means that the maximum developing toner weight was lowered from 8 ($g/m^2$) to 5.3 ($g/m^2$) in a system having transfer efficiency 85 (wt %).

It was found that it is necessary to satisfy conditional expression (1): $1 \leqq T/a \leqq 1.2$.

where a is a value equivalent to the weight per unit area when the toner is the densest as one layer, and is defined by the following expression:

$$a=(4\pi/3)\cdot(dt/2)^3\cdot\rho t/\{(3)^{1/2}\cdot dt^2/2\}) \ (g/m^2)$$

where dt is a toner volume center diameter (m) and ρt is a toner density ($g/m^3$).

In the consideration, it can be verified that if the relation $1 \leqq T/a$ is satisfied, the ground of the recording medium 24 does not show. It is practical to set the upper limit value of T/a to 1.2; the main reasons are that if the value exceeds 1.2, gradation crush in a high-concentration area (shadow area) becomes remarkable with respect to image quality and that the running cost is increased.

According to the considerations the developing toner weight can be lowered without showing the ground of the recording medium 24 and replacement problem (1) can be solved. However, if the toner particle diameter is made small, toner scatter easily occurs when the same charge amount (charge amount per unit weight) is applied. Thus, it is desirable to handle the toner near the upper limit value of the optimum toner charge amount range.

The upper limit value of the optimum toner charge amount range is determined by transfer unevenness and transfer unevenness can be prevented by sharpening the large particle size side in the toner particle size distribution. Thus, the specification can also be reconsidered as required. However, it leads to an increase in the toner manufacturing costs thus it is desirable to carry out in the cost range that can be reduced by decreasing the toner amount used at the image formation time.

By the way, it is down-earth to control the developer deposition amount on the developing sleeve 401*a* and the circumferential speed of the developing sleeve 401*a* as well as the toner concentration as means - for solving replacement problem (1).

As also guessed from the sweep pattern occurrence range in FIG. 5, if the toner supply amount to the latent image support 11 becomes insufficient, practical image formation is made impossible; it is indispensable to supply minimum necessary toner. As a result of study, it was found that it is necessary to satisfy the following conditional expression (2) particularly under a high-humidity condition wherein the toner concentration during the machine operation lowers:

Conditional expression (2): $M\cdot Rt\cdot v \geqq a/(k\cdot s\times10^{-6})$ where M ($g/m^2$) is the developer deposition amount per unit area on the developing sleeve 401*a*, Rt (wt %) is the toner concentration in the developers v is the surface speed ratio of the developing sleeve 401*a* to the latent image support 11, s (wt %) is the toner transfer rate from the developing sleeve 401*a* to the latent image support 11, k (wt %) is the transfer rate in transfer process, and a is the amount represented by the conditional expression (1) described above.

Figure 6:
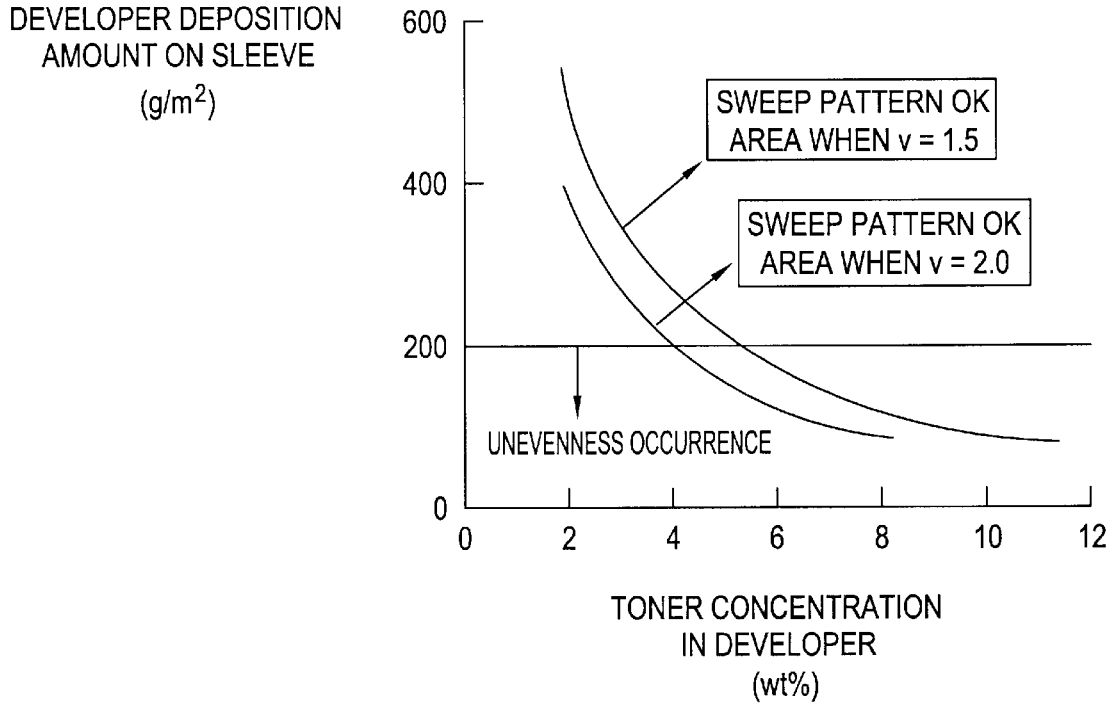
FIG. 6 is a graph to show the relationship between the toner concentration in a developer and the developer deposition amount on a developing sleeve in the embodiment of the invention.

FIG. 6 shows an example examined to derive the conditional expression (2).

The sweep pattern occurrence range in FIG. 6 is applied when the value of a is about 4.5 ($g/m^2$), s=35 (%), and k is 85 (%).

According to the consideration, a new problem arising in solving replacement problem (1) can also be solved.

Next, a solution to replacement problem (2), namely, a problem of realizing a developer having characteristics as developer B in FIG. 5 while providing the charge maintainability and efficient usage thereof will be discussed.

For replacement problem (2), it was clarified that putting carriers into a small particle diameter is the most effective. Specifically, carriers are prepared by putting a coat of the same coat thickness as the conventional coat thickness on a ferrite core with volume center diameter of $35\times10^{-6}$ (m) and density of about $3.5\times10^{6}$ ($g/m^3$) and are combined with toner having particle diameter $6.5\times10^{-6}$ (m) to produce a developer, which is a typical developer close to the developer B in FIG. 1.

The carriers in the developer, which have the same coat thickness as the conventional coat thickness, do not impair charge maintainability. The possible reason why putting carriers into a small particle diameter is effective for decreasing practical resistivity is that when a developer of the same volume exists between the developing sleeve 401*a* and the latent image support 11 the number of the contacts of the carriers increases in a practical toner concentration range and resultantly the practical resistivity can be lowered.

For putting carriers into a small particle diameter, there was apprehension that carrier scatter occurs when the developing sleeve 401*a* is rotated at high speed because practical magnetization per carrier lessens. However, the magnetic flux density on the developing sleeve 401*a* is raised from 100 (mT) to 135 (mT) whereby the developer can be used efficiently with no carrier scatter until the surface speed is about 500 (mm/sec) on the developing sleeve 401*a* 30 (mm) in diameter.

However, if the volume center diameter falls below $30\times10^{-6}$ (m) it becomes difficult to use the developer efficiently; the device cannot be configured unless the magnetic flux density on the developing sleeve 401*a* is raised at drastically increased costs.

According to the consideration, replacement problems (1) and (2) can be solved and the problem of "skip in a halftone area adjoining a solid area" can be solved. In the consideration process, means capable of furthermore correcting the "skip in a halftone area adjoining a solid area" if the practical resistivity in the measurement method described above is the same can be derived.

Figure 7:
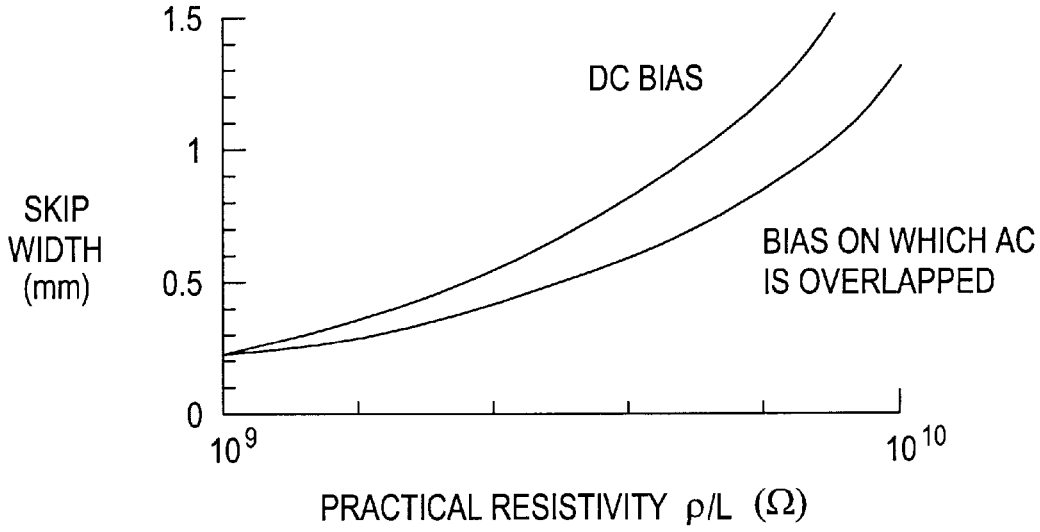
FIG. 7 is a graph to show how the relationship between practical resistivity and the skip width in a halftone area adjoining a solid area changes depending on the developing bias difference in the embodiment of the invention.

Specifically, if an AC component is overlapped onto a developing bias, the "skip in a halftone area adjoining a solid area" can be corrected furthermore, as shown in FIG. 7.

To use the conventional developer, namely, the developer provided by combining the carriers each with the volume center diameter $50\times10^{-6}$ (m) and the toner each particle with the volume center diameter $9.5\times10^{-6}$ (m) or to use the developer effective for solving the problem, namely, the developer provided by combining the carriers each with the volume center diameter $35\times10^{-6}$ (m) and the toner each particle with the volume center diameter $6.5\times10^{-6}$ (m), the upper limit of the toner concentration range during the machine operation is about 13 (wt %), preferably 12 (wt %) as shown in FIG. 5.

This means that the toner coverage should be set to about 54% or less, preferably 50% or less in the above-described calculation method in the conventional developer and should be set to about 56% or less, preferably 51% or less in the developer (B) effective for solving the problem.

Thus, setting the toner coverage to about 55% or less becomes a condition on executing the image formation system according to the embodiment. This condition becomes an important guideline for selecting the carrier diameter and the toner diameter to prevent fog from occurring. Last, four color developers of the invention will be discussed. As listed in Table 1, the new developers have colorant content percentage higher than the conventional developers. That is, TMA (Toner Mass per unit Area) is lowered and the content percentage is increased accordingly, whereby a desired concentration can be provided. For color toner, preferably the content percentage is about 5.0%–8.0%; for black toner, preferably the content percentage is about 4.0%–6.0%.

TABLE 1

| | | CONVENTIONAL | | | NEW | | | |
|---|---|---|---|---|---|---|---|---|
| COLOR | COLORANT | TONER CENTER DIAMETER (μm) | COLORANT CONTENT PERCENTAGE (%) | TMA (g/m²) | TONER CENTER DIAMETER (μm) | COLORANT CONTENT PERCENTAGE (%) | TMA (g/m²) | VALUES OF EXPRESSION IN CLAIM 1 |
| Y | C.I. Pigment Yellow 17 | 7.8 | 5 | 6.5 | 6.5 | 7.2 | 4.5 | T/a = 1.04 @pt = 1.1 |
| M | C.I. Pigment Red 57:1 | 7.8 | 4 | 6.5 | 6.5 | 5.8 | 4.5 | T/a = 1.04 @pt = 1.1 |
| C | C.I. Pigment Blue 15:3 | 7.8 | 4 | 6.5 | 6.5 | 5.8 | 4.5 | T/a = 1.04 @pt = 1.1 |
| K | Carbon Black | 9.5 | 3 | 10.0 | 8.5 | 4.6 | 6.5 | T/a = 1.05 @pt = 1.1 |

In the example shown in the figures a rectangular wave having frequency 9 kHz and peak-to-peak voltage 1 kV is used.

Figure 8:
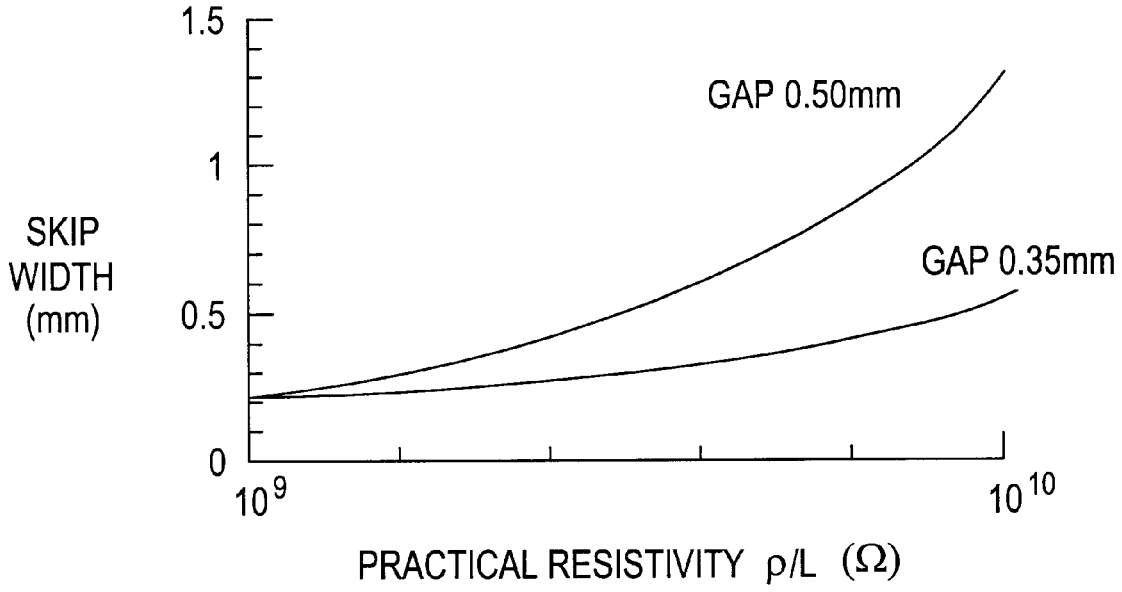
FIG. 8 is a graph to show how the relationship between practical resistivity and the skip width in a halftone area adjoining a solid area changes depending on the gap difference between the developing sleeve and a latent image support in the embodiment of the invention.

Further, if the gap between the latent image support 11 and the developing sleeve 401*a* is made narrower than the conventional gap, the "skip in a halftone area adjoining a solid area" can also be corrected furthermore, as shown in FIG. 8.

Besides, additional information is provided on toner coverage for the carriers in the developer when the correction means is executed.

The toner coverage mentioned here is defined in the calculation method described in the above.

As we have discussed, according to the invention, the toner amount of the solid area having the maximum toner amount per unit area on the recording medium is optimized, whereby the "skip in a halftone area adjoining a solid area" can be corrected completely.

Further, the toner amount on a recording medium such as paper lessens, thereby also producing secondary effects of correcting toner scatter at the transfer time, missing transfer caused by toner thickness difference, heavy line images, recording medium bend or warp after fixing, price per print sheets etc.

What is claimed is:

1. A developing method for an image formation system comprising the steps of:

supplying a toner; and developing an electrostatic latent image formed on a latent image support of the image formation system with the toner for visualization, such that a toner amount of a solid area T ($g/m^2$) having a maximum toner amount per unit area on a recording medium satisfies an expression as follows:

$$1 \leqq T/a \leqq 1.2$$

wherein $a=(4\pi/3)\cdot(dt/2)^3\cdot\rho t/\{(3)^{1/2}\cdot dt^2/2\}$ ($g/m^2$), where dt is a toner volume center diameter (m), and ρt is a toner density ($g/m^3$).

2. The developing method of claim 1, further comprising the step of using a dual component developer having the toner and carriers.

3. The developing method of claim 2, further comprising the step of satisfying another expression as follows:

$$M\cdot Rt\cdot v \geqq a/(k\cdot s\times 10^{-6})$$

wherein

M ($g/m^2$) is a developer deposition amount per unit area on a developing sleeve, Rt (wt %) is a toner concentration in the developer, v is a surface speed ratio of said developing sleeve to said latent image support, s (wt %) is a toner transfer rate from said developing sleeve to said latent image support, and k (wt %) is a transfer rate in a transfer process.

4. The developing method of claim 2, wherein carriers are used, the carriers having practical resistivity defined by a measurement method ranging from $10^6$ (Ω) to $10^{10}$ (Ω) for a resistance characteristic thereof, said measurement method comprising the steps of:

depositing carriers of 500±25 ($g/m^2$) on a developing sleeve for forming heads, opposing said developing sleeve to a conductive pipe having the same diameter as said latent image support, holding a gap between said developing sleeve and said conductive pipe to t (cm), applying a direct current of 1,000 (V) between said developing sleeve and said conductive pipe, finding resistance R (Ω), and defining ρ/L (Ω units) found from $R=\{t/(b\cdot L)\}\cdot\rho$ when t=0.05 cm as the practical resistivity, where b (cm) is a length in a length direction of said developing sleeve for said heads to come in contact with said conductive pipe, L (cm) is an effective contact width in a circumferential direction of said developing sleeve, and ρ(Ω·cm) is volume resistivity of a carrier layer.

5. The developing method of claim 2, wherein carriers are used, each carrier having a volume center diameter less than $50\times10^{-6}$ m and being equal to or greater than $30\times10^{-6}$ m.

6. The developing method of claim 2, wherein a gap between said latent image support and a developing sleeve is 0.2 to $0.4\times10^{-3}$ m.

7. The developing method of claim 2, wherein an AC component is overlapped onto a developing bias.

8. The developing method of claim 2, wherein toner coverage on a carrier surface is 55% or less in a toner coverage calculation method of calculating toner coverage, the toner coverage calculation method being:

$$(Rt/4)\cdot(dc/dt)\cdot(\rho c/\rho t)$$

wherein dt (m) in the toner volume center diameter,

ρt ($g/m^3$) is the toner density, dc (m) is a carrier volume center diameter,

ρc ($g/m^3$) is a carrier density, and

Rt (wt % ) is a toner concentration in the dual component developer.

9. A developing device for developing an electrostatic latent image formed on a latent image support with toner for visualization, said developing device comprising:

toner amount regulation means for regulating a toner amount so as to satisfy conditional expression (1) when the toner amount of a solid area T ($g/m^2$) having the maximum toner amount per unit area on a recording medium as follows:

Conditional expression (1): $1 \leqq T/a \leqq 1.2$ wherein $a=(4\pi/3)\cdot(dt/2)^3\cdot\rho t/\{(3)^{1/2}\cdot dt^2/2\}$ ($g/m^2$) where dt is a toner volume center diameter (m) and ρt is a toner density ($g/m^2$).

10. An image formation system using said developing device of claim 9 as a developing device for visualizing the electrostatic latent image on the latent image support.

* * * * *